United States Patent [19]

Nakamura et al.

[11] Patent Number: 4,668,244

[45] Date of Patent: May 26, 1987

[54] METHOD AND APPARATUS FOR UPGRADING LOW RANK COAL

[75] Inventors: Yoichi Nakamura, Kanagawa; Akio Yamamoto, Kudamatsu; Goro Kurita, Yamaguchi; Jinichi Tomuro, Katsuta; Toshio Kuge, Hitachi, all of Japan

[73] Assignee: Hitachi, Ltd., Tokyo, Japan

[21] Appl. No.: 768,114

[22] Filed: Aug. 21, 1985

[30] Foreign Application Priority Data

| | | | |
|---|---|---|---|
| Aug. 22, 1984 | [JP] | Japan | 59-173203 |
| Aug. 24, 1984 | [JP] | Japan | 59-174932 |
| Sep. 7, 1984 | [JP] | Japan | 59-186311 |
| Sep. 7, 1984 | [JP] | Japan | 59-186312 |
| Sep. 14, 1984 | [JP] | Japan | 59-191511 |

[51] Int. Cl.[4] ..... C10L 9/08; C10L 5/22

[52] U.S. Cl. ..... 44/1 F; 44/2; 34/215

[58] Field of Search ..... 44/1 G, 1 R, 10 E, 10 J, 44/2; 34/215; 201/18; 202/243

[56] References Cited

U.S. PATENT DOCUMENTS 4,249,909 2/1981 Comolli ..... 44/1 G

*Primary Examiner*—Carl F. Dees

*Attorney, Agent, or Firm*—Antonelli, Terry & Wands

[57] ABSTRACT

A method and apparatus for upgrading low rank coal, wherein the sealing efficiency between the inside and the outside of a system and between the successive stages of apparatus is improved. Such improvement is provided between a drying apparatus for drying low rank coal into dried coal and a carbonizing apparatus for carbonizing the dried coal into carbonized coal and between the carbonizing apparatus and a cooling/adsorbing apparatus for cooling said carbonized coal and the cooled carbonized coal is caused to absorb therein a tar produced from the carbonization of the dried coal to thereby provide improved coal. In this method and apparatus inflow of an outside atmosphere from the outside into the inside of the system and mixing of gases between said successive stages of apparatus is restrained so that low rank coal is able to be favorably and consecutively upgraded regardless of operating pressures of the respective stages of apparatus.

17 Claims, 8 Drawing Figures

METHOD AND APPARATUS FOR UPGRADING LOW RANK COAL

BACKGROUND OF THE INVENTION

1. Field of the Invention

The present invention relates to a method and apparatus for upgrading low rank coal, and more particularly to a method and apparatus for upgrading low rank coal which is suitable to consecutively upgrade low rank coal.

2. Description of the Prior Art

There is known a technique for heat-treating low rank coal such as sub-bituminous coal and lignite through a plurality of stages to consecutively upgrade low rank coal, as disclosed in U.S. Pat. No. 4,249,909 by way of example, in which low rank coal is supplied by a first stage apparatus from the outside of a system for drying, the dried low rank coal is fed through a rotary feeder from the first stage apparatus to a second stage apparatus where the fed coal is carbonized and at the same time the pores of coal particles are blocked with material such as tar, then the low rank coal thus treated is fed through a rotary feeder from the second stage apparatus to a final stage apparatus to be cooled therein, and thereafter the cooled coal is taken out from the final stage apparatus to the outside of the system.

However, because such a conventional technique has not considered the problem of sealing between the inside and the outside of system as well as between the successive stage apparatus in the system, the outside atmosphere may flow into the system or inner gases may mix with each other between the successive apparatus in the system depending on the operating pressures of the respective stage apparatus, with the result that the process of upgrading low rank coal would be adversely affected.

SUMMARY OF THE INVENTION

It is an object of the present invention to provide a method and apparatus for upgrading low rank coal which permits favorably consecutively upgrading the low rank coal irrespective of the operating pressure in each stage of the apparatus.

The method for upgrading low rank coal according to the present invention is featured in comprising the steps of; drying the low rank coal into dried coal; carbonizing the dried coal into carbonized coal; cooling the carbonized coal; and causing the cooled carbonized coal to adsorb tar produced from the dried coal in the carbonizing process to provide improved coal, wherein inflow of the outside atmosphere into a drying process atmosphere of the low rank coal as well as a tar adsorbing process atmosphere of the cooled carbonized coal is restrained, and wherein mixing gas generated from the low rank coal during the drying process with gas generated from the dried coal during the carbonizing process when the dried coal is fed into the carbonizing process atmosphere, as well as mixing the above gases with the cooling process atmosphere gas of the cooled carbonized coal and tar adsorbing process atmosphere of the cooled carbonized coal when the carbonized coal is fed into the cooling process atmosphere, are also restrained. The apparatus for upgrading low rank coal is featured in comprising; a drying apparatus for drying the low rank coal into dried coal; a carbonizing apparatus for carbonizing the dried coal into carbonized coal; and a cooling/adsorbing apparatus for cooling the carbonized coal and causing the cooled carbonized coal to adsorb tar produced from the dried coal in the carbonizing process to provide improved coal, wherein a drying apparatus is provided with means for supplying the low rank coal thereto while restraining the inflow of the outside atmosphere, the drying apparatus is connected with the carbonizing apparatus through means having the function of feeding the dried coal from the drying apparatus to the carbonizing apparatus and the function of restraining the mixing of the inner gas of the drying apparatus with the inner gas of the carbonizing apparatus, the carbonizing apparatus is connected with the cooling/adsorbing apparatus through means having the function of feeding the carbonized coal from the carbonizing apparatus to the cooling/adsorbing apparatus and the function of restraining the mixing of the inner gas of the carbonizing apparatus with the inner gas of the cooling/adsorbing apparatus, and wherein the cooling/adsorbing apparatus is provided with means for taking the improved coal out of the system while restraining the inflow of the outside atmosphere. In short, the present invention is intended to improve the sealing efficiency between the inside and the outside of system and between successive stages of the apparatus, thereby restraining the inflow of the outside atmosphere from the outside into the system as well as restraining the mixing of inner gases between the successive stage apparatus.

DESCRIPTION OF THE PREFERRED EMBODIMENTS

One embodiment of the present invention will be described with reference to FIGS. 1 through 4.

Figure 1:
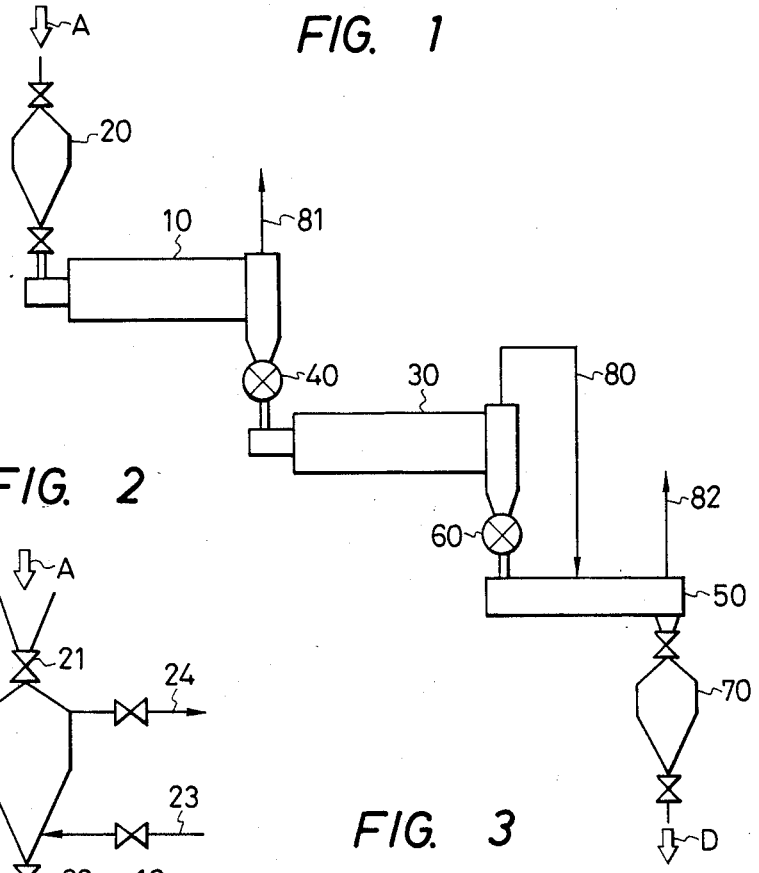
FIG. 1 is a flow diagram showing one example of an apparatus for upgrading low rank coal embodying the present invention.

Referring first to FIG. 1, a drying apparatus 10 is provided with means, e.g., one unit of rock hopper 20, for providing low rank coal to the drying apparatus 10 while restraining the inflow of the outside atmosphere. The drying apparatus 10 is connected to a carbonizing apparatus 30 through means e.g., a rotary feeder 40, having the function of feeding the low rank coal while being upgraded from the drying apparatus 10 to the carbonizing apparatus 30 and the function of restraining mixing of the inner gas of the drying apparatus 10 with that of the carbonizing apparatus 30. The carbonizing apparatus 30 is connnected to a cooling/adsorbing apparatus 50 through means, e.g., a rotary feeder 60, having the function of feeding the low rank coal while being upgraded from the carbonizing apparatus 30 to the cooling/ adsorbing apparatus 50 and the function of restraining the mixing of the inner gas of the carbonizing apparatus 30 with that of the cooling/adsorbing apparatus 50. The cooling/adsorbing apparatus 50 is provided with means, e.g., one unit of a rock hopper 70, for taking the upgraded low rank coal out of the cooling/adsorbing apparatus 50 to the outside of the system while restraining inflow of the outside atmosphere.

The above process of upgrading low grade coal will first be described briefly.

In FIG. 1, low rank coal A, such as sub-bituminous coal or lignite, having a high water content and low caloric value is supplied to the drying apparatus 10 through the rock hopper 20 to be dried and dehydrated therein. The dehydrated, dried coal B is supplied to the carbonizing apparatus 30 through the rotary feeder 40 to be carbonized at temperatures of 250°–450° C. therein. In this process, hydrophilic radicals in the dried coal B are thermally decomposed for transformation to highly hydrophobic carbonized coal C. This carbonized coal C is fed to the cooling/ adsorbing apparatus 50 through the rotary feeder 60. Meanwhile, tar produced from the dried coal B during the carbonizing process is supplied from the carbonizing apparatus 30 to the cooling/adsorbing apparatus 50 via a line 80. In the cooling/adsorbing apparatus 50, the carbonized coal B is cooled causing the cooled carbonized coal B to adsorb the tar, to thereby provide upgraded low rank coal (hereinafter referred to simply as improved coal) D having a lower water content, a higher caloric value and excellent moisture resistance. The improved coal D is taken out to the outside of the system through the rock hopper 70. Water vapor produced from the low rank coal A during the drying/dehydrating process in the drying apparatus 10 is discharged to the outside of the system via a line 81. Further, excessive tar is exhausted to the outside of the system via a line 82 for burning.

The structure and function of each component will be described below.

Figure 2:
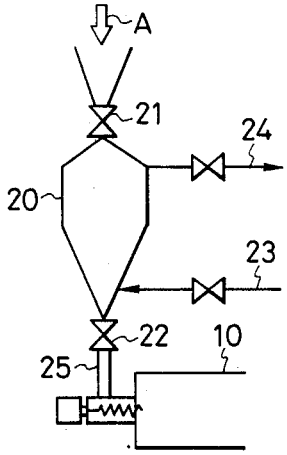
FIGS. 2 and 3 are schematic views of a rock hopper in FIG. 1.

Referring to FIG. 2 there is shown a structure of the rock hopper 20 on the supply side, the rock hopper 20 is provided with a valve 21 at the top and a valve 22 at the bottom. The rock hopper 20 further includes an inert gas supply line 23 and an exhaust line 24. The low rank coal A is supplied to the rock hopper 20 after first closing the valve 22 and then opening the valve 21. When the rock hopper 20 becomes filled with the supplied coal, the valve 21 is closed and the inert gas supply line 23 as well as exhaust line 24 are opened to replace air in the rock hopper 20 by inert gas. Thereafter, the inert gas supply line 23 as well as the exhaust line 24 are closed and the valve 22 is opened to start supply of the low rank coal A to the drying apparatus 10. Because the drying time of the low rank coal A in the drying apparatus 10 is about 1 hour, the hydration efficiency will not be substantially affected even if supply of the low rank coal A to the drying apparatus 10 is suspended for a period of time no longer than 10 min during the time when the low rank coal A is supplied to the rock hopper 20 in the manner as mentioned above. Regardless of such suspension, the low grade coal A can be continuously supplied to the drying apparatus 10 by designing a space 25 between the valve 22 and the drying apparatus 10 to have capacity containing the amount of coal enough to be supplied for 10 min. Therefore, without the need to provide two rock hopper units 20 and employing either of them alternately in a switchable manner, adoption of the above method permits continuous supply of the low rank coal with only one rock hopper unit 20, thereby reducing the equipment cost correspondingly. Note that, if water vapor produced from the low grade coal A during the drying process thereof in the drying apparatus 10 flows back into the rock hopper 20 causing the coal to clog in the rock hopper 20, the inert gas supply line 23 should be opened at least during the opening time that the valve 22 is open so as to supply inert gas to the rock hopper 20 to prevent such clogging.

Figure 3:
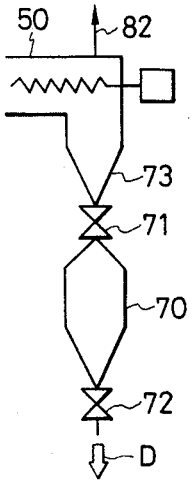

Referring now to FIG. 3 there is shown a structure of the rock hopper 70 on the exhaust side, the rock hopper 70 is provided with a valve 71 at the top and a valve 72 at the bottom. Between the cooling/adsorbing apparatus 50 and the valve 71, there is provided an exhaust space section 73 having the capacity enough to contain the amount of the improved coal D which has been accumulated during the interval required for taking out the improved coal D stored in the rock hopper 70. With this structure, without the need to provide two rock hopper units 70 and employing either one of them alternately in a switchable manner, the improved coal D can be continuously taken out with only one rock hopper unit 70 and the equipment cost can be reduced correspondingly. The purpose of providing the rock hopper 70 is to restrain the tar with the inner gas, both to be exhausted together when taking the improved coal D out of the cooling/adsorbing apparatus 50, and to make the inflow of air into the system as practical as possible.

Details of the rotary feeders 40, 60 will be described below with reference to FIG. 4.

Figure 4:
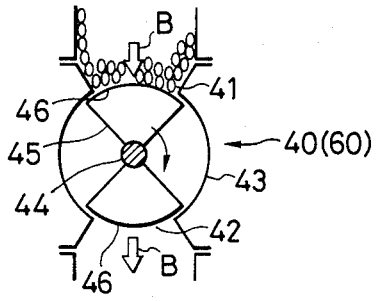
FIG. 4 is a longitudinal sectional view showing the structure of a rotary feeder in FIG. 1.

In the embodiment shown in FIG. 4, an outer cylinder 43 has openings 41, 42 in the upper and lower portions, respectively, and a rotary shaft 44 is provided in the outer cylinder 43 to be rotatable about the axis thereof. The rotary shaft 44 is provided with a plurality of radial partitions 45. Each of the partitions 45 has a length selected not to prevent its rotation within the outer cylinder 43. The partitions 45 have at their distal ends a pair of shield plates 46 formed in a shape corresponding to the rotating locus of those distal ends and symmetrically with an angular spacing of 180 degrees, in the illustrated example. The size of the shield plates 46 is selected enough to close the openings 41, 42. The rotary shaft 44 is rotated by a suitable driver (not shown).

In FIG. 4, when there is no need to feed the dried coal B from the upstream stage apparatus, e.g., the drying apparatus 10 of FIG. 1, to the downstream stage apparatus, e.g, the carbonizing apparatus 30 of FIG. 1, the openings 41, 42 are both shielded by the shield plates 46. After that, when the dried coal B must be fed, the rotary shaft 44 is intermittently rotated so that the open spaces between the partitions 45 including no shield plate 46 are located corresponding to the openings 41, 42. This causes the dried coal B having been stored in one open space between the partitions 45 to be supplied to the carbonizing apparatus 30 through the opening 42, and the new dried coal B to be stored in the other open space between the partitions 45 from the drying apparatus 10 through the opening 41. With such an operation, the dried coal B is intermittently fed from the drying apparatus 10 to the carbonizing apparatus 30. Likewise, the carbonized coal C is fed also intermittently from the carbonizing apparatus 30 to the cooling- /adsorbing apparatus 50 in FIG. 1. As a result, it becomes possible to restrain the mixing of inner gases between the successive apparatus (less than 1%) regardless of operating pressures of the respective apparatus. Furthermore, from the viewpoint of structure, the dried coal B and the carbonized coal C can be both prevented from abrading so that the rotary feeders 40, 60 may be smoothly operated in a stable fashion.

According to this embodiment, since the sealing efficiency between the inside and the outside of system, as well as between the drying apparatus and the carbonizing apparatus and between the carbonizing apparatus and the cooling/adsorbing apparatus in the system can be improved, and inflow of at least air into the drying apparatus and the cooling/adsorbing apparatus, as well as mixing of inner gases between the successive stage apparatus can be restrained, there results the effect that low rank coal can be favorably, consecutively upgraded irrespective of the operating pressures of the respective apparatus.

A second embodiment of the present invention will be described with reference to FIG. 5.

Figure 5:
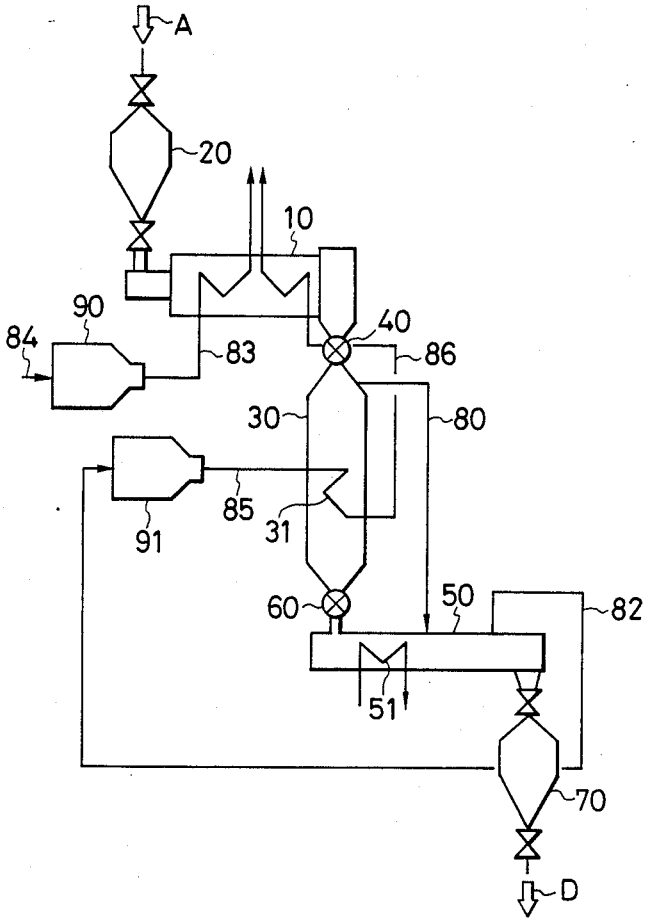
FIG. 5 is a flow diagram showing a second example of the apparatus for upgrading low rank coal embodying the present invention.

In FIG. 5, low rank coal A is supplied through a rock hopper 2 to a drying apparatus 10 such as a rotary drum type drier where the low rank coal is dried into dried coal B. In this drying process, there is mainly employed a heat medium a generated in a heat medium generator 90 and supplied via a line 83. Coal b as fuel is supplied to the heat medium generator 90 via a line 84 and burnt therein to generate the heat medium a. The dried coal B is supplied through a rotary feeder 40 from the drying apparatus 10 to a carbonizing apparatus 30 where it is carbonized to become carbonized coal C. The carbonizing apparatus 30 is of an apparatus incorporating a heating pipe 31 by way of example, which is typically the moving layer type. The carbonized coal C is supplied through a rotary feeder 60 from the carbonizing apparatus 30 to the cooling/adsorbing apparatus 50 where it undergoes a cooling and tar adsorbing process to become improved coal D which is then taken out of the system through a rock hopper 70. The improved coal D taken out of the system is once stored in a suitable storage site (not shown) and, thereafter, burnt in a combustion boiler (not shown) of, for example, a power station.

In FIG. 5, during the carbonizing process of the dried coal B in the carbonizing apparatus 30, there generate gases c such as tar, resin, lower hydrocarbon gases (e.g., methane, ethane), etc. from the dried coal B, these gases c being taken out of the carbonizing apparatus 30 via a line 80 and supplied to the cooling/adsorbing apparatus 50. The gases c supplied to the cooling/adsorbing apparatus 50 come into contact with the carbonized coal C which has been indirectly cooled by a coolant, e.g., cooling water, passing through a cooling pipe 51. As a reusult, tar constituting the gases c is adsorbed onto the carbonized coal C. Gases c' thus deprived of most tar are taken out of the cooling/adsorbing apparatus 50 and then supplied as fuel via a line 82 to the heat medium generator 91 where they are burnt to generate a heat medium d. This heat medium d is supplied to the heating pipe 31 of the carbonizing apparatus 30 via a line 85. The dried coal B is indirectly heated by the heat medium d passing through the heating pipe 31 for carbonizing. After that, a heat medium d' is exhausted from the heating pipe 31, but it has still relatively high temperatures. Therefore, the heat medium d' is supplied to the drying apparatus 10 via a line 86 so that it is utilized as a part of the heat medium for the drying and dehydrating process of the low rank coal A.

In this way, because the rotary drum type drier or the like is adopted to indirectly heat the low rank coal A, there are no problems even when a small amount of ashes is mixed in the heat medium. Further, because the head medium d generated by burning the gases c' as fuel is employed as a heat medium for carbonizing the dried coal B, there is no fear of mixing of ashes into the heat medium and, as a result, the moving layer type of carbonizing apparatus can be adopted without creating problems.

TABLE 1

| (Example) | |
|---|---|
| Water Content | 25.3% |
| Ash Content | 5.1% |
| Volatile Matter | 35.6% |
| Fixed Carbon | 34.0% |
| Heating Value | 4980 kcal/kg |
| Fuel Ratio | 0.96 |

TABLE 2

| | |
|---|---|
| Water Content | 10.3% |
| Ash Content | 7.0% |
| Vollatile Matter | 29.5% |
| Fixed Carbon | 53.2% |
| Heating Value | 6450 kcal/kg |
| Fuel Ratio | 1.80 |

A test was conducted using sub-bituminous coal from the West in the United States and having properties as shown in Table 1. The drying temperature and the carbonizing temperature were set at 150° C. and 350° C., respectively. The amount of generated lower hydrocarbon gases was 37 $Nm^3$/t-material coal, and the caloric value was 5,700 kcal/g and supplied to the heat medium generator for carbonization. The generated heat medium was mixed with air for cooling, supplied to the carbonizing apparatus at 725° C. and then exhausted therefrom at 410° C. As a consequence, the resulting improved coal had the property shown in Table 2 which is very suitable for utilization as fuel coal for boilers.

In addition to the effect attained by the foregoing first embodiment of the present invention, this second embodiment offers another effect that, since gases generated from the dried coal during the carbonizing process thereof are employed as fuel to produce a heat medium which is then used to carbonize the dried coal, the dried coal can be carbonized using a heat medium free of ashes so that an apparatus incorporating a heating pipe can be adopted as the carbonizing apparatus without problems.

A third embodiment of the present invention will be described with reference to FIG. 6. When attempting to upgrade low rank coal to have a quality equivalent to that of high rank coal represented by bituminous coal through drying, carbonizing and cooling/tar adsorbing processes, the low rank coal needs to be fully dried and dehydrated in the drying/dehydrating process such that the water content becomes substantially zero. When the drying/dehydrating process is performed with the indirect heating type using hot gas as a heat medium, it is not preferable to utilize a countercurrent for the best efficiency because the inlet temperature of hot gas reaches a higher range of 600°–700° C. so that the dried coal is excessively heated near the outlet of the drying apparatus. Meanwhile, adoption of the parallel current type to prevent such excessive heating increases the size of the drying apparatus. More specifically, the length is increased by about 20% in comparison with the countercurrent type of the same drum diameter and the equipment coal is increased correspondingly. This solution was therefore also unsatisfactory. As a result of experiments and studies which aim to solve this problem, it was found that low rank coal is held at a temperature of about 100° C. and not excessively heated until water in the low rank coal has been completely evaporated. It is thus concluded that, with the section corresponding to the process where water has been completely evaporated from the low rank coal being of the countercurrent type and with only the subsequent section corresponding to the process where the dried coal is raised up in its temperature from 100° C. to 150° C. and fed out to the carbonizing apparatus being of parallel current type, the overall size remains almost equal to that of the completely countercurrent type without causing the problem of excessive heating because the countercurrent type section occupies a principal part of the apparatus.

Figure 6:
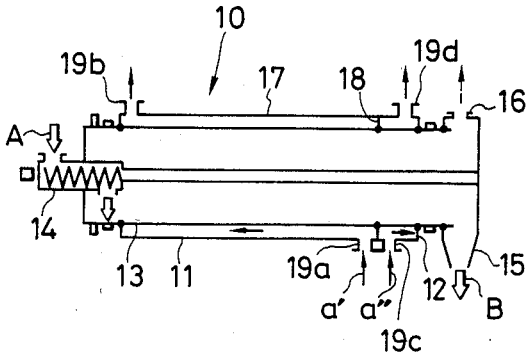
FIG. 6 is a longitudinal sectional view of a drying apparatus, showing a third embodiment of the present invention.

Referring to FIG. 6, a drying apparatus 10 of horizontal rotary indirect heating type has a heating section which is separated independently longitudinally (to the right and left in the drawing) into a heating section 11 on the low rank coal supply side and a heating section 12 on the dried coal outlet side. A heat medium a' is capable of passing through the heating section 11 in countercurrent relation, while a heat medium a'' is capable of passing through the heating section 12 in parallel current relation. More specifically, a drum 13 is provided with a screw feeder 14, for example, at the low rank coal supply end (the left end in the drawing) and with an outlet 15 and a vapor exit 16 at the dried coal outlet end (the right end in the drawing). A jacket 17 is disposed outside of the drum 13 with a space defined therebetween, the space being separated by a partition 18 into the heating sections 11, 12. The jacket 17 has a heat medium inlet 19*a* and a heat medium outlet 19*b* both provided in communication with the heating section 11, as well as a heat medium inlet 19*c* and a heat medium outlet 19*d* both provided in communication with the heating section 12. The heat medium inlet 19*a* and outlet 19*b* are disposed so that the heat medium a' passes through the heating section 11 in countercurrent relation. The heat medium inlet 19*c* and outlet 19*d* are disposed so that the heat medium a'' passes through the heating section 12 in parallel current relation. The heating section 11 is designed to have a length required for low rank coal A to be heated up to 100° C. so that most of water in the low rank coal A has been evaporated, while the heating section is designed to have a length required for the dried coal B to be heated up to 150° C. so that the water is completely removed. The length ratio of the heating section 11 to the heating section 12 is dependent on parameters such as the total water content of the low rank coal A, temperatures of the heat medium a', a'' and temperature of the dried coal B to be taken out, but ideally in a range of 7:3 through 9:1. With the length ratio between the heating sections 11 and 12 set at 9:1, for example, the length of the drum 13 is increased by just 2% in comparison with that of the conventional countercurrent type, with the result that an increase in size of the apparatus can be restrained.

When applying the drying apparatus of this embodiment to a drying apparatus to be used in the foregoing first embodiment of the present invention, there can be achieved, the effect of the restraining an increase in size of the drying apparatus and hence avoiding a raise-up of the equipment cost, in addition to the effect attained by the first embodiment of the present invention. Furthermore, since the low rank coal is prevented from being excessively heated during the drying process thereof, contained water can be removed from the low rank coal without causing any byproducts of thermal decomposition, such as phenol, thus resulting in the effect that the drain process can be simplified.

A fourth embodiment of the present invention will be described with reference to FIG. 7.

Figure 7:
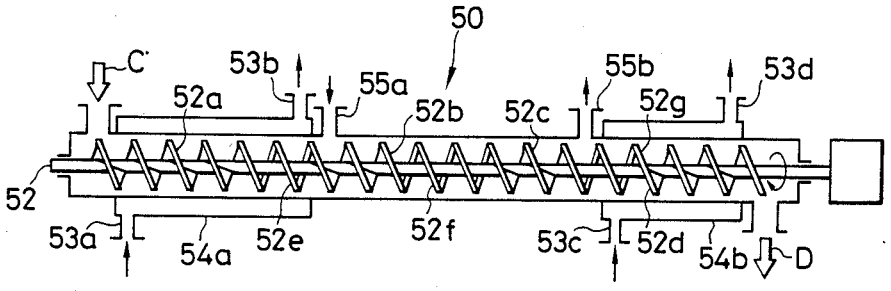
FIG. 7 is a structural view of a cooling/adsorbing apparatus, showing a fourth embodiment of the present invention.

In FIG. 7, the carbonized coal C supplied by means of a rotary feeder (not shown) from a carbonizing apparatus (not shown) to a cooling/adsorbing apparatus 50 in the form of a screw feeder, is sequentially fed by a screw 52 through the steps of cooling, tar adsorbing and recooling to become improved coal D, which is taken out of the system through a rock hopper (not shown). A coolant, e.g., cooling water, is supplied from an inlet port 53*a* and then exhausted out of a drain port 53*b* after passing through a jacket 54*a*. The supplied carbonized coal C is indirectly cooled with the cooling water passing through the jacket 54*a*. On this occasion, the carbonized coal C is cooled down to temperatures above 70° C., preferably in a range of 70°–about 100° C., that is suitable for adsorption of tar. Tar is introduced from an inlet 55*a*, and most of the introduced tar is adsorbed onto the carbonized coal C having been cooled down to the above temperature. The surplus tar is exhausted out through an outlet 55*b*. A coolant, e.g., cooling water is supplied from an inlet port 53*c* and then is exhausted out of a drain port 53*d* after passing through a jacket 54*b*. The improved coal D is indirectly cooled with cooling water passing through the jacket 54*b*. On this occasion, the improved coal D is cooled down to temperatures below 50° C. such that the improved coal D will not ignite spontaneously, even when it is taken out of the system through the rock hopper and directly heaped up in a storage site (not shown) by way of example. Furthermore, the screw 52 comprises sections 52*a*–52*d* consisting of flexible plates and ribbonlike sections 52*e*–52*g* having only their outer circumferences. Accordingly, the carbonized coal C and the improved coal D are caused to pass through the sections 52*a*–52*d* consisting of flexible plates with a filling rate of 10–20%, but pass through the ribbon-like sections 52*e*–52*g* having only their outer circumferences with the filling rate of nearly 100%.

When applying the cooling/adsorbing apparatus of this embodiment to a cooling/adsorbing apparatus to be used in the foregoing first embodiment of the present invention, there can be achieved, the effect that, since the improved coal is taken out of the system after being cooled down to temperatures below 50° C., it is possible to prevent the improved coal from igniting spontaneously even when it is taken out of the system and directly heaped up in a storage site or the like, in addition to the effect attained by the first embodiment of the present invention.

A fifth embodiment of the present invention will be described with reference to FIG. 8.

Figure 8:
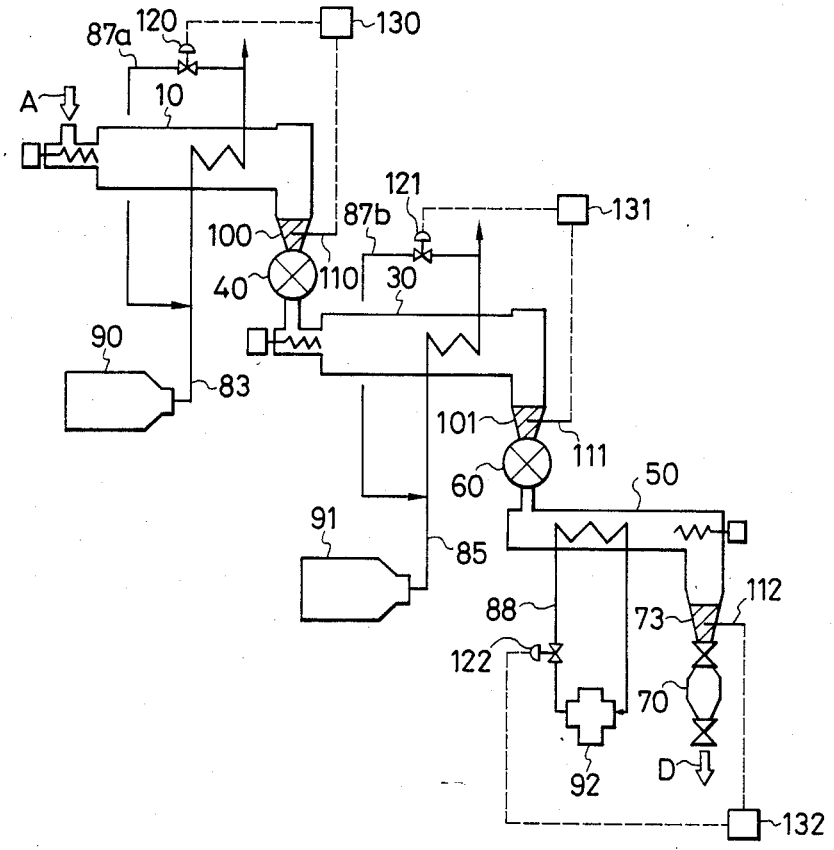
FIG. 8 is a schematic diagram showing the flow in a fifth example of the apparatus for upgrading low rank coal embodying the present invention.

In FIG. 8, a rotary feeder 40 is controlled in its rotation so that the dried coal B always resides in an outlet section 100 of a drying apparatus 10. A thermocouple 110 is disposed in the outlet section 100 at such a location that the thermocouple 110 is always buried in the residing dried coal B. With this arrangement, the thermocouple 110 gives a substantially precise temperature of the dried coal B. Hot gas as a heat medium is indirectly supplied to the drying apparatus 10 from a heat medium generator 90 via a line 83, thereby indirectly heating the low rank coal A for drying and dehydrating. A diluted gas line 87*a* is connected to the line 83 to supply the exhaust gas at a reduced temperature after heating as diluted gas thereto, and a flow rate control valve 120 is provided midway in the diluted gas line 87*a*. The degree of opening of the flow rate control valve 120 is controlled by a controller 130 in accordance with the thermocouple 110. To confirm that rotation of the rotary feeder 40 is controlled so that the thermocouple 110 is always buried in the dried coal B, a pair of level meters can be mounted in the upper and lower portions of the outlet section 100 by way of example. Likewise, a rotary feeder 60 is controlled in its rotation so that the carbonized coal C always resides in an outlet section 101 of a carbonizing apparatus 30. A thermocouple 111 is disposed in the outlet section 101 at location where the thermocouple 111 is always buried in the residing carbonized coal C. With this arrangement, the thermocouple 111 gives a substantially precise temperature of the carbonized coal C. Hot gas as a heat medium is indirectly supplied to the carbonizing apparatus 30 from a heat medium generator 91 via a line 85, thereby indirectly heating the dried coal B for carbonization. Further, another diluted gas line 87*b* is connected to the line 85 to supply exhaust gas lowered in its temperature after heating as diluted gas thereto, and a flow rate control valve 121 is provided midway another diluted gas line 87*b*. The flow rate control valve 121 has its degree of opening controlled by a controller 131 in accordance with the thermocouple 111. To confirm that rotation of the rotary feeder 60 is controlled so that the thermocouple 111 is always buried in the carbonized coal C, a pair of level meters can be mounted in the upper and lower portions of the outlet section 101. Furthermore, a thermocouple 112 is disposed in an outlet section 73 of a cooling/adsorbing apparatus 50 at such a location that the thermocouple 112 is always buried in the improved coal D. With this, the thermocouple 112 gives a substantially precise temperature of the improved coal D. The volume of the outlet section 73 is selected to be larger than that of a rock hoper 70 so that the improved coal D always resides in the outlet section 73. Cooling water as a coolant is indirectly supplied from a coolant source 92 to the cooling/adsorbing source 50 via a line 88, whereby the carbonized coal C is indirectly cooled for cooling and the thus-cooled carbonized coal C is successively subjected to the tar adsorbing process. A flow rate control valve 122 is provided midway the line 88. The degree of opening of the flow rate control valve 122 is controlled by a controller 132 in accordance with the thermocouple 112. Incidentally, the controllers 130–132 store therein the relationship between temperature of the dried coal B and temperature of the low rank coal during the drying process in the drying apparatus 10, the relationship between temperature of the carbonized coal C and temperature of the dried coal during the carbonizing process in the carbonizing apparatus 30, and the relationship between temperature of the improved coal d and temperature of the carbonized coal during the cooling and tar adsorbing process in the cooling/adsorbing apparatus 50, respectively. Accordingly, for example, temperature of the low rank coal during the drying process in the drying apparatus 10 can be known by determining temperature of the dried coal B residing in the outlet section 100 of the drying apparatus 10, whereby such temperature of the low rank coal can be favorably controlled at the setting temperature under control of the opening degree of the flow rate control valve 120.

In addition to the effect attained by the foregoing first embodiment of the present invention, this embodiment permits to precisely monitor temperatures of the low rank coal, dried coal and the carbonized coal in the drying, carbonizing and cooling/tar adsorbing process sections, respectively, and to feed back the detected results to the corresponding heating or cooling circuit for precise control of temperature, thus leading to the effect that the stable improved coal can be produced with the optimum conditions.

As described above, according to the present invention, there can be obtained a method for upgrading low rank coal comprising the steps of; drying low rank coal into dried coal; carbonizing the dried coal into carbonized coal; cooling the carbonized coal; and causing the cooled carbonized coal to adsorb tar produced from the dried coal in the carbonizing process to provide improved coal, wherein inflow of the outside atmosphere into a drying process atmosphere of the low rank coal as well as a tar adsorbing process atmosphere of the cooled carbonized coal is restrained, and wherein mixing of gas generated from the low rank coal during the drying and dehydrating process with gas generated from the dried coal during the carbonizing process at the time when the dried coal is fed into the carbonizing process atmosphere, as well as mixing of the above gases with cooling process atmosphere of the carbonized coal and tar adsorbing process atmosphere of the cooled carbonized coal at the time when the carbonized coal is fed into the cooling process atmosphere, are also restrained. There can be further obtained an apparatus for upgrading low rank coal comprising; a drying apparatus for drying the low rank coal into dried coal; a carbonizing apparatus for carbonizing the dried coal into carbonized coal; and a cooling/adsorbing apparatus for cooling the carbonized coal and causing the cooled carbonized coal to adsorb tar produced from the dried coal in the carbonizing process to provide improved coal, wherein the drying apparatus is provided with means for supplying the low rank coal thereto while restraining inflow of the outside atmosphere, the drying apparatus is connected with the carbonizing apparatus through means having a function to feed the dried coal from the drying apparatus to the carbonizing apparatus and a function to restrain mixing of inner gas of the drying apparatus with inner gas of the carbonizing apparatus, the carbonizing apparatus is connected with the cooling/adsorbing apparatus through means having a function to feed the carbonized coal from the carbonizing apparatus to the cooling/adsorbing apparatus and a function to restrain mixing of inner gas of the carbonizing apparatus with inner gas of the cooling/adsorbing apparatus, and wherein the cooling/adsorbing apparatus is provided with means for taking the improved coal out of the system while restraining inflow of the outside atmosphere. As a result, it becomes possible to improve the sealing efficiently between the inside and the outside of system and between the successive stage apparatus, as well as to restrain inflow of at least the outside atmosphere from the outside into the system and mixing of inner gases between the successive stage apparatus, with the resulting effect that low rank coal can be favorably, consecutively upgraded regardless of operating pressures of the respective stage apparatus.

What is claimed is:

1. A method for upgrading low rank coal comprising the steps of; drying said low rank coal into dried coal; carbonizing said dried coal into carbonized coal; cooling said carbonized coal; and causing said cooled carbonized coal to adsorb tar produced from said dried coal in the carbonizing process to provide improved coal, wherein inflow of the outside atmosphere into a drying process atmosphere of said low rank coal as well as a tar adsorbing process atmosphere of said cooled carbonized coal is restrained, and wherein mixing of gas generated from said low rank coal during the drying and dehydrating process with gas generated from said dried coal during the carbonizing process at the time when said dried coal is fed into the carbonizing process atmosphere, as well as mixing of said gases with cooling process atmosphere gas of said carbonized coal and tar adsorbing process atmosphere gas of said cooled carbonized coal at the time when said carbonized coal is fed into the cooling process atmosphere, are also restrained.

2. The method for upgrading low rank coal according to claim 1, wherein the gas containing said tar produced from said dried coal in the carbonizing process is burnt and said dried coal is carbonized using the heat generated from the burning.

3. The method for upgrading low rank coal according to claim 1, wherein the gas generated from said dried coal in the carbonizing process and deprived of most tar through the tar adsorbing process is burnt, and said dried coal is carbonized using the heat generated from the burning.

4. The method for upgrading low rank coal according to claim 1, wherein said low rank coal is dried by heating said low rank coal up to 100° C. with a heat medium flowing in a countercurrent relation and then heating same up to 150° C. with a heat medium flowing in a parallel current relation.

5. The method for upgrading low rank coal according to claim 1, wherein said carbonized coal is cooled down to temperatures suitable for adsorption of said tar, and said improved coal is cooled down to such temperatures that it will not ignite spontaneously even when said improved coal is taken out of the system and directly heaped up.

6. The method for upgrading low rank coal according to claim 5, wherein said carbonized coal is cooled down to temperatures above 70° C., preferably in a range of 70° about 100° C., and said improved coal is cooled down to temperatures below 50° C.

7. The method for upgrading low rank coal according to claim 1, wherein temperature of said dried coal is detected to control temperature of said low rank coal during the drying process at the setting temperature in accordance with the detected temperature, the temperature of said carbonized coal is detected to control temperature of said dried coal during the carbonizing process at the setting temperature in accordance with the detected temperature, and the temperature of said improved coal is detected to control the temperature of said carbonized coal during the cooling and tar adsorbing process at the setting temperature in accordance with the detected temperature.

8. An apparatus for upgrading low rank coal comprising: a drying apparatus for drying said low rank coal into dried coal; a carbonizing apparatus for carbonizing said dried coal into carbonized coal; and a cooling/adsorbing apparatus for cooling said carbonized coal and causing the cooled carbonized coal to adsorb tar produced from said dried coal in the carbonizing process to provide improved coal, wherein said drying apparatus is provided with means for supplying said low rank coal thereto while restraining the inflow of the outside atmosphere, said drying apparatus is connected with said carbonizing apparatus through means having a function to feed said dried coal from said drying apparatus to said carbonizing apparatus and a function to restrain mixing of inner gas of said drying apparatus with inner gas of said carbonizing apparatus, said carbonizing apparatus is connected with said cooling/adsorbing apparatus through means having a function to feed said carbonized coal from said carbonizing apparatus to said cooling/adsorbing apparatus and a function to restrain mixing the inner gas of said carbonizing apparatus with the inner gas of said cooling/adsorbing apparatus, and wherein said cooling/adsorbing apparatus is provided with means for taking said improved coal out of the system while restraining the inflow of the outside atmosphere.

9. The apparatus for upgrading low rank coal according to claim 8, wherein said means for supplying said low rank coal to said drying apparatus while restraining the inflow of the outside atmosphere is of a rock hopper, said means having a function to feed said dried coal from said drying apparatus to said carbonizing apparatus and a function to restrain mixing the inner gas of said drying apparatus with the inner gas of said carbonizing apparatus, as well as said means having a function to feed said carbonized coal from said carbonizing apparatus to said cooling/adsorbing apparatus and a function to restrain mixing the inner gas of said carbonizing apparatus with the inner gas of said cooling/adsorbing apparatus are each of a rotary feeder, and said means for taking said improved coal out of the system while restraining the inflow of the outside atmosphere is a rock hopper.

10. The apparatus for upgrading low rank coal according to claim 9, wherein said rotary feeder is composed of; an outer cylinder having an inlet opening and an outlet opening for said dried coal or said carbonized coal; a rotary shaft provided in said outer cylinder to be rotatable about an axis of said outer cylinder; a driver for rotating said rotary shaft; a plurality of partitions radially mounted to said rotary shaft and having such a length as not to impair their rotation within said outer cylinder; and a plurality of shield plates mounted on said partitions to intermittently close said openings upon rotation of said rotary shaft.

11. The apparatus for upgrading low rank coal according to claim 8, wherein said drying apparatus is of a drying apparatus of horizontal rotary indirect heating type, and a heating section of this drying apparatus is separated independently longitudinally into a heating section on the low rank coal supply side where a heat medium is capable of passing therethrough in countercurrent relation, and a heating section on the dried coal outlet side where a heat medium is capable of passing therethrough in a parallel current relation.

12. The apparatus for upgrading low rank coal according to claim 11, wherein the length ratio of said heating section for the low rank coal supply to said heating section for the dried coal outlet is selected so as to be within a range of 7:3 through 9:1.

13. The apparatus for upgrading low rank coal according to claim 8, where said cooling/adsorbing apparatus is of a screw feeder having a tar adsorbing process section for said cooled carbonized coal and a cooling process section for said improved coal in a successive fashion, and a screw of said screw feeder comprises a section composed of flexible plates and a ribbon-like section having only the outer circumference.

14. The apparatus for upgrading low rank coal according to claim 8, wherein thermocouples are provided for detecting the temperature of said dried coal residing in an outlet section of said drying apparatus, the temperature of said carbonized coal residing in an outlet section of said carbonizing apparatus and the temperature of said improved coal residing in the outlet section of said cooling/adsorbing apparatus, respectively, and flow rate control valves controlled in their degree of opening by controllers in accordance with said thermocouples are provided midway in a dilute gas line connected with a line supplying a heat medium to said drying apparatus, another dilute gas line connected with a line supplying a heat medium to said carbonizing apparatus, and a line supplying a coolant to said cooling/adsorbing apparatus, respectively.

15. The apparatus for upgrading low rank coal according to claim 14, wherein said dilute gas line is of a line supplying exhaust gas of alower temperature after heating said low rank coal as dilute gas, and said another dilute gas line is of a line supplying exhaust gas of a lower temperature after heating said dried coal as dilute gas.

16. An apparatus for upgrading low rank coal which comprises:

a drying apparatus;

a first rock hopper for supplying a low rank coal to said drying apparatus while restraining the inflow of outside atmosphere located at an inlet of said drying apparatus through which said low rank coal is fed to be dried into dried coal;

a carbonizing apparatus for carbonizing the dried coal;

a first rotary feeder for feeding dried coal from said drying apparatus to said carbonizing apparatus, said first rotary feeder comprising an outer cylinder having an inlet opening and an outlet opening for said dried coal, a rotary shaft provided in said outer cylinder to be rotatable about the axis of said outer cylinder, a driver for rotating said rotary shaft, a plurality of partitions radially mounted to said rotary shaft and having such a length as not to impair their rotations within said outer cylinder, and a plurality of shield plates mounted on said partitions to intermittently close said openings upon rotation of said rotary shaft and said rotary feeder being arranged to connect an outlet of said drying apparatus through which said dried coal is discharged to an inlet of the carbonizing apparatus through which said dried coal is fed thereto to be carbonized into carbonized coal;

a cooling/adsorbing apparatus for cooling the carbonized coal and for contacting the cooled coal with tar to be adsorbed by said cooled coal;

a second rotary feeder for feeding carbonized coal from said carbonizing apparatus to said cooling-/adsorbing apparatus, said second rotary feeder comprising an outer cylinder having an inlet opening and an outlet opening for said carbonized coal, a rotary shaft provided in said outer cylinder to be rotatable about the axis of said outer cylinder, a driver for rotating said rotary shaft, a plurality of partitions radially mounted to said rotary shaft and having such length as not to impair their rotations within said outer cylinder, and a plurality of shield plates mounted on said partitions to intermittently close said openings upon rotation of said rotary shaft and said second rotary feeder being arranged to connect an outlet of said carbonizing apparatus through which said carbonized coal is discharged to an inlet of the cooling/adsorbing apparatus through which said carbonized coal is fed to be cooled, and means for introducing as tar produced from the carbonization of said dried coal into the cooling/adsorbing apparatus to be adsorbed into the cooled carbonized coal to produce an improved coal; and a second rock hopper for taking said improved coal out of the cooler/adsorbing apparatus while restraining the inflow of outside atmosphere arranged at an outlet of said cooling/adsorbing apparatus through which said improved coal is discharged from the apparatus.

17. An apparatus for upgrading low rank coal according to claim 16, wherein said first rock hopper includes an inlet control valve and an outlet control valve and means for introducing an inert gas into low rank coal retained within the first rock hopper to remove air therefrom prior to opening the outlet valve and introducing the low rank coal into the drying apparatus.

* * * * *